US006605792B2

(12) United States Patent
Sato

(10) Patent No.: US 6,605,792 B2
(45) Date of Patent: Aug. 12, 2003

(54) PUSH-PUSH SWITCH FOR SWITCHING HEAVY-CURRENT

(75) Inventor: Yukihiko Sato, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/020,271

(22) Filed: Dec. 14, 2001

(65) Prior Publication Data

US 2002/0092756 A1 Jul. 18, 2002

(30) Foreign Application Priority Data

Dec. 14, 2000 (JP) ..... 2000-384914

(51) Int. Cl.[7] ..... H01H 3/42

(52) U.S. Cl. ..... 200/524; 200/520; 200/344; 200/239

(58) Field of Search ..... 200/520, 523, 200/524, 525, 341, 534, 239, 240, 275, 296, 6 R, 529

(56) References Cited

U.S. PATENT DOCUMENTS 3,040,142 A 6/1962 Dietrich et al.
4,616,116 A * 10/1986 Sato ..... 200/242
4,968,860 A * 11/1990 Shinohara et al. ..... 200/314
5,512,717 A 4/1996 Magome et al.
6,335,500 B1 * 1/2002 Chi et al. ..... 200/341

FOREIGN PATENT DOCUMENTS

DE 27 37 221 2/1979
EP 0 851 447 7/1998

* cited by examiner

*Primary Examiner*—Elvin Emad
*Assistant Examiner*—K. Lee
(74) *Attorney, Agent, or Firm*—Brinks Hofer Gilson & Lione

(57) ABSTRACT

The desired low-priced and small-sized switch is configured so that a moving contact is provided with first and second contacts, the first contact is made of noble metal, a pair of fixed terminals are respectively provided with a fixed contact, the first and second contacts are touched to each of the fixed contacts by pressure on the moving contact by a first coil spring and the first contact of the moving contact is separated from the fixed contact earlier than the second contact by moving an operating shaft downward in an axial direction against the pressure of the first coil spring.

4 Claims, 5 Drawing Sheets

PUSH-PUSH SWITCH FOR SWITCHING HEAVY-CURRENT

BACKGROUND OF THE INVENTION

1. Field of the Invention

The present invention relates to a switch, particularly relates to a push-push switch for switching heavy-current.

2. Description of the Related Art

It is known that variable and fixed contacts of a conventional type switch, particularly a push-push switch for switching heavy-current are deformed or worn by arc discharge by switching (turning on or off) heavy-current of each contact.

Therefore, the variable and fixed contacts have been variously configured to prevent deformation or abrasion, however, in any case, they have complex structures or high-priced contact material to prevent deformation and abrasion is used.

As the conventional type switch is formed by a body in which a mechanism having complex structure of the variable and fixed contacts is housed, the body is large-sized.

As described above, as the conventional type switch is a switch for switching heavy-current, the structure of the variable and fixed contacts is complex and each contact is formed by a member using high-priced contact material which endures switching heavy-current.

As a result, there is a problem that the body housing the variable and fixed contacts is large-sized and as they are formed by a contact member using high-priced contact material, the cost of the switch is increased and a small-sized and low-priced switch is desired.

SUMMARY OF THE INVENTION

A switch according to the invention is made to solve the abovementioned problems and the object is to provide a small-sized and low-priced switch.

The switch according to the invention is provided with a body, an operating shaft housed in the body, a moving contact arranged in the body so that it is moved in an axial direction of the operating shaft, a pair of fixed terminals arranged in the body so that they are located over the moving contact and a first coil spring housed on the side of a bottom wall of the body so that it presses the moving contact upward in the axial direction of the operating shaft and is characterized in that the moving contact is provided with first and second contacts provided at both ends, the first contact is made of noble metal, a pair of fixed terminals are respectively provided with a fixed contact, the first and second contacts are touched to each fixed contact by pressure on the moving contact by the first coil spring, touching an end of the operating shaft to the moving contact by moving the operating shaft downward in the axial direction, and the first contact of the moving contact is separated from the fixed contact of the fixed terminal earlier than the second contact by further pushing down the operating shaft against the pressure of the first coil spring and the first contact of the moving contact is touched to the fixed contact of the fixed terminal later than the second contact by the pressure of the first coil spring by returning the operating shaft.

According to such a configuration, as the first contact made of noble metal is earlier separated from the fixed contact and is later touched to the fixed contact, high-priced material is required for only the first contact on one side and the stable and long life can be achieved even if the low-priced heavy-current switch is operated.

The switch according to the invention is also characterized in that the moving contact is formed by a flat plate and is composed of a base substantially in a center and first and second arms at both ends, the first arm in which the first contact is provided is bent downward in a bent part in relation to the base and the first and second contacts are touched to each of the fixed contacts by inclining the base in relation to the fixed contact and most approaching the bent part to an end of the operating shaft by the pressure of the first coil spring on the base of the moving contact.

According to such a configuration, as the moving contact is formed by a flat plate and is formed by bending a part, the configuration is simple and the low-priced moving contact is acquired.

The switch according to the invention is also characterized in that a hole is formed in a center of the moving contact, the second coil spring pierces the hole of the moving contact, the second coil spring is arranged coaxially with the first coil spring inside the first coil spring and the second coil spring presses the operating shaft upward in the axial direction of the operating shaft.

According to such a configuration, as the first coil spring and the second coil spring are coaxially arranged and the second coil spring for pressing the operating shaft pierces the hole of the moving contact, space can be effectively utilized and the switch can be small-sized.

The switch according to the invention is also characterized in that a strut perpendicularly extended from the bottom wall is provided on the bottom wall of the body, the first and second coil springs are provided along the strut and the operating shaft is arranged at an end of the strut so that the operating shaft can be moved upward or downward in the axial direction.

According to such a configuration, the first and second coil springs and the operating shaft can be easily positioned by the strut.

The switch according to the invention is also provided with a body, an operating shaft housed in the body, a moving contact arranged in the body so that the moving contact is moved in an axial direction of the operating shaft, a pair of fixed terminals arranged in the body so that they are positioned over the moving contact and a first coil spring housed on the side of a bottom wall of the body so that it presses the moving contact upward in the axial direction of the operating shaft and is also characterized in that the body is composed of an upper case and a lower case, the lower case has opposite side walls, a pair of opposite convexes are formed on sides of each open end of the side walls, the moving contact pressed by the first coil spring is temporarily tacked in the lower case by fitting both ends of the moving contact to a pair of convexes, the fixed terminal is attached to the lower case from the upside of the moving contact, fitting between one of a pair of convexes and the moving contact is released by elastically pressing the fixed terminal on the moving contact against the pressure of the first coil spring, the upper case covers the lower case from a side of the open end, an end of the operating shaft touches to the moving contact by moving the operating shaft downward in the axial direction, and the moving contact is separated from the fixed terminal by further pushing down the operating shaft against the pressure of the first coil spring and the moving contact is touched to the fixed terminal by the pressure of the first coil spring by returning the operating shaft.

According to such a configuration, in an assembly process, the first coil spring and the moving contact are temporarily tacked in the lower case and the efficiency of assembly can be enhanced.

DETAILED DESCRIPTION OF THE PREFERRED EMBODIMENT

Figure 1:
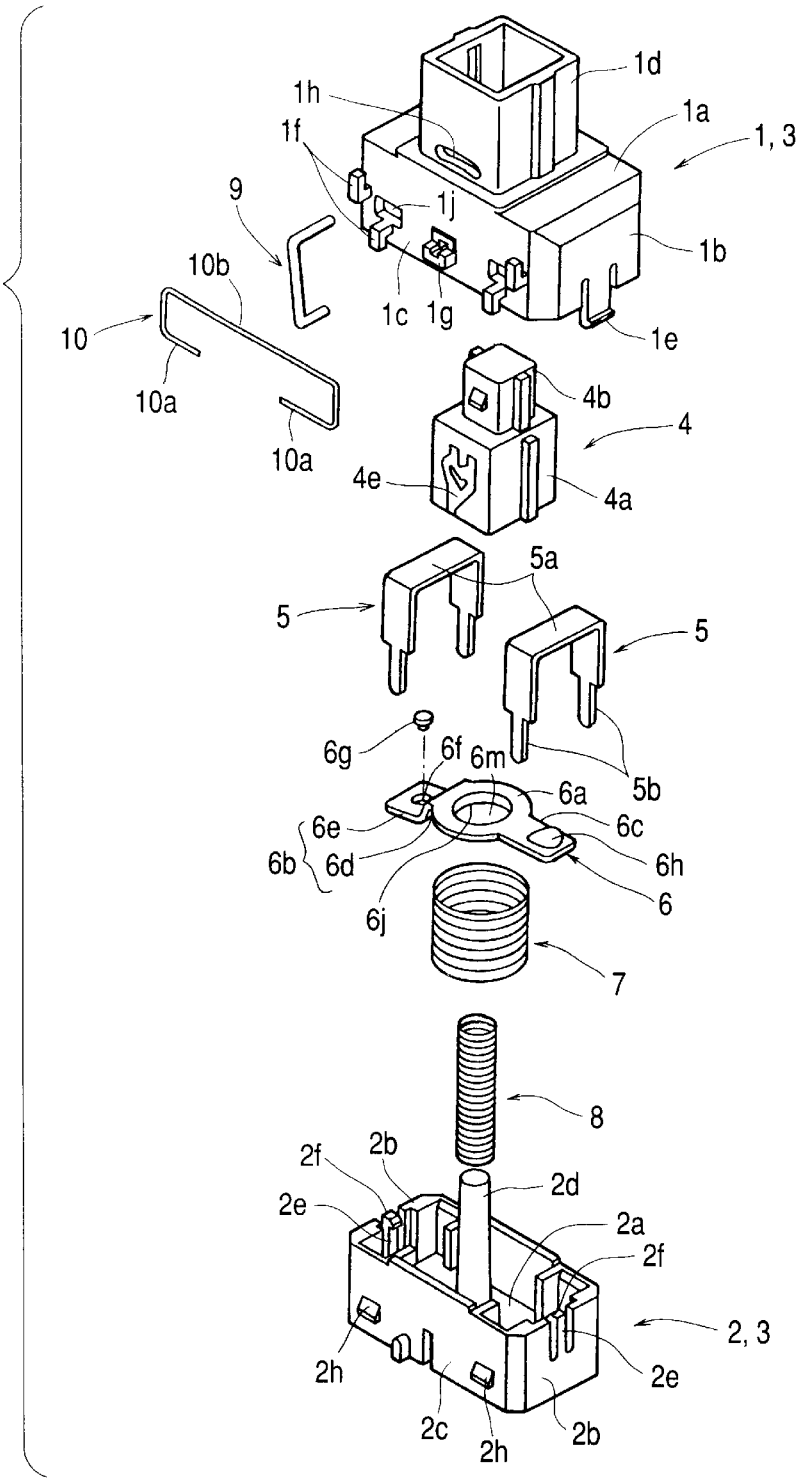
FIG. 1 is an exploded perspective view showing an embodiment of a switch according to the invention.

Referring to the drawings, an embodiment of a switch according to the invention will be described below.

Figure 2:
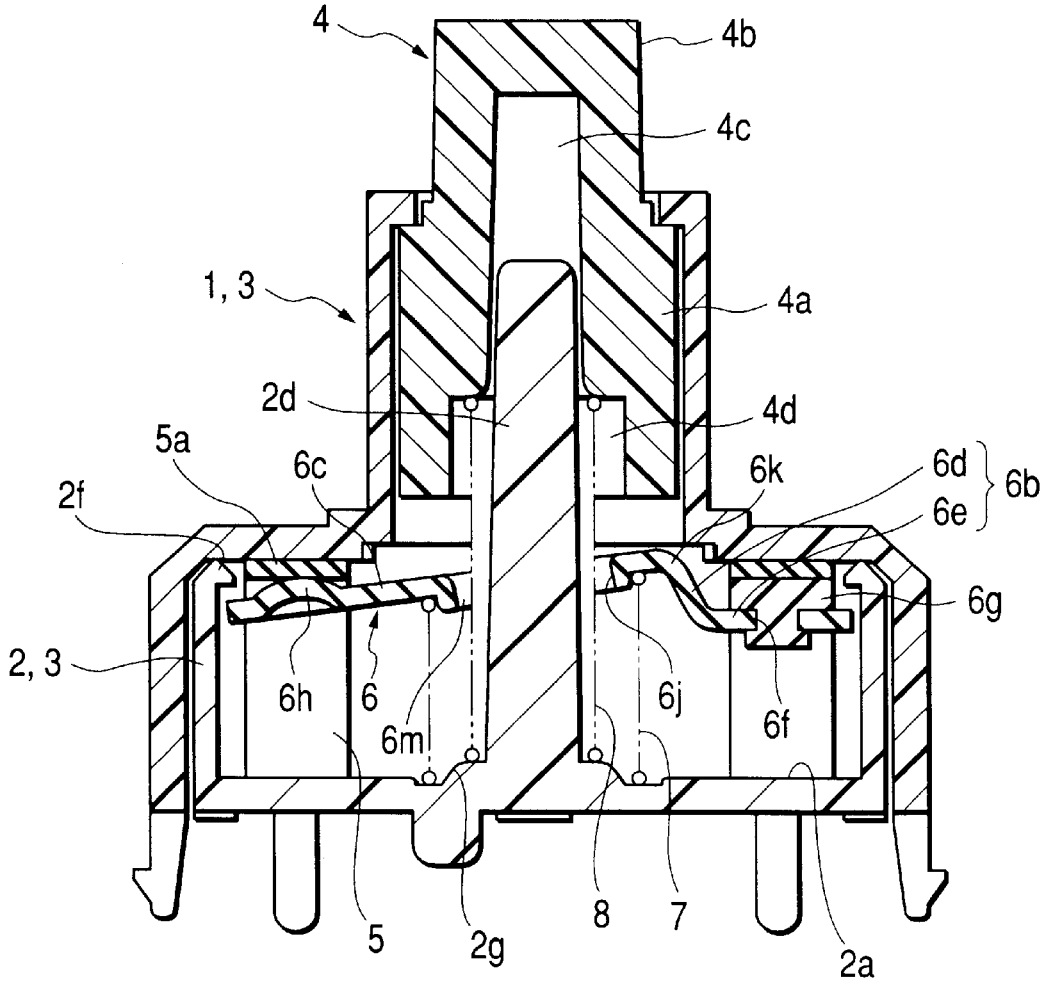
FIG. 2 is a sectional view showing the embodiment of the switch according to the invention.

FIG. 1 is an exploded perspective view showing an embodiment of the switch according to the invention and FIG. 2 is a sectional view showing the embodiment of the switch according to the invention.

As shown in FIGS. 1 and 2, the switch according to the invention is substantially composed of a body 3 including an upper case 1 and a lower case 2, an operating shaft 4, a pair of fixed terminals 5, a moving contact 6, a first coil spring 7 and a second coil spring 8.

The upper case 1 is made of synthetic resin for example, is formed substantially in the shape of a box by fabrication and is provided with a substantially rectangular upper wall 1*a*, side walls 1*b* and 1*c* perpendicularly extended from the four peripheral edges of the upper wall 1*a* and a rectangular sleeve 1*d* extended from the substantially the center of the upper wall 1*a* to the outside.

A fitting piece 1*e* extended in parallel with the side walls 1*b* and 1*b* is respectively provided to one pair of opposite side walls 1*b* and 1*b*.

Also, a pair of holes 1*j* are respectively formed on both other pair of side walls 1*c* and two pairs of four L-type protrusions 1*f* and a fitting part 1*g* provided substantially in the center are formed on one side. A long hole 1*h* is formed on the side of the sleeve 1*d*.

The lower case 2 is made of synthetic resin for example, is formed substantially in the shape of a box by fabrication and is provided with a bottom wall 2*a*, side walls 2*b* and 2*c* perpendicularly extended from the four peripheral edges of the bottom wall 2*a* and a cylindrical strut 2*d* protruded from the substantial center of the bottom wall 2*a* to the inside of the lower case 2. The end of the strut 2*d* is protruded outside from the open ends of the side walls 2*b* and 2*c*.

A circular convex 2*g* is provided to the base of the strut 2*d* so that the circular convex surrounds the strut 2*d*.

Also, tongues 2*e* and 2*e* provided in parallel with the side walls 2*b* and 2*b* and extended on the sides of the open ends of the side walls 2*b* and 2*b* and fitting parts 2*f* and 2*f* as a convex respectively protruded from the tongues 2*e* and 2*e* to the inside of the lower case 2 are formed on one pair of opposite side walls 2*b* and 2*b*.

Also, a pair of convexes 2*h* are respectively formed on the other pair of opposite side walls 2*c*.

The lower case 2 is fitted to the upper case 1 by respectively snap-in fitting a pair of convexes 2*h* of the lower case 2 into a pair of holes 1*j* of the upper case 1, the upper case 1 and the lower case 2 are integrated and the body 3 is formed.

The operating shaft 4 as a slider is made of synthetic resin for example, is formed substantially in the shape of a box by fabrication and is provided with a rectangular base 4*a* and a control 4*b* protruded from the upper surface of the base 4*a* to the outside.

Also, a cylindrical first hole 4*c* having a predetermined diameter and a second hole 4*d* having a larger diameter than that of the first hole 4*c* and communicating with the first hole 4*c* are formed in the center of the base 4*a* and the control 4*b*. Also, a cam concave 4*e* forming a so-called heart cam is formed on one side of the base 4*a*.

The operating shaft 4 is housed in the sleeve 1*d* of the upper case 1 and at this time, the control 4*b* is protruded from the upper surface of the sleeve 1*d* to the outside. Also, at this time, the strut 2*d* of the lower case 2 is inserted into the first hole 4*c* of the operating shaft 4.

The fixed terminal 5 is made of metallic material such as copper, phosphor bronze and a copper alloy, is formed by press working, the whole is C-letter shaped and is provided with a flat fixed contact 5*a* and a pair of terminal parts 5*b* and 5*b* perpendicularly extended from the fixed contact 5*a*.

This fixed terminal 5 is fixed to the bottom wall 2*a* of the lower case 2 by press fitting for example. A pair of (two) fixed terminals 5 are arranged on the bottom wall 2*a* and each end of a pair of terminal parts 5*b* and 5*b* of the fixed terminal 5 is protruded from the bottom wall 2*a* to the outside. At this time, the fixed contact 5*a* of the fixed terminal 5 and the bottom wall 2*a* are parallel.

The moving contact 6 is made of metallic material such as copper, phosphor bronze and a copper alloy, is formed by a flat plate by press working and is provided with a base 6*a* substantially in the center, a hole 6*m* provided substantially in the center of the base 6*a*, a first arm 6*b* extended from a part of the peripheral edge of the base 6*a* to the outside and a second arm 6*c* located in a position symmetrical with the first arm 6*b* and extended from a part of the peripheral edge of the base 6*a* to the outside.

The first arm 6*b* is composed of a first inclined part 6*d* at a predetermined first angle with the base 6*a* and a second inclined part 6*e* at a second angle and a circular hole 6*f* is provided in the center of the second inclined part 6*e*. That is, a bent part 6*k* is provided between the base 6*a* and the first inclined part 6*d* and the first arm 6*b* is bent downward for the base 6*a* at the bent part 6*k*.

A first contact 6*g* having a tip, made of noble metal such as gold, silver and a silver alloy and formed by press working is arranged in the hole 6*f*. The first contact 6*g* is fixed and integrated to/with the hole 6*f* by caulked joint for example.

The second arm 6*c* is formed on the same plane with the base 6*a* and substantially in the center, a second contact 6*h* protruded hemispherically is formed.

The moving contact 6 is arranged so that the first contact 6*g* is touched to the inside of the fixed contact 5*a* of one out of a pair of (two) fixed terminals 5 and the second contact 6*h* is touched to the inside of the other fixed contact 5*a*. That is, at this time, the switch is in an ON state.

The angle of inclination between the base 6*a* and the second inclined part 6*e* is set to an angle at which the second inclined part 6*e* and the terminal part 5*b* of the fixed terminal 5 are substantially parallel in a state in which the switch is turned on.

A protruded circular convex 6*j* is provided to the inner edge of the base 6*a*.

In this state, the circular base 6*a* of the moving contact 6 is pierced by the strut 2*d* of the lower case 2.

Further, in this state, the base 6*a* and the second arm 6*c* of the moving contact 6 are inclined at a predetermined angle with the bottom wall 2*a* of the lower case 2 and the second inclined part 6*e* of the first arm 6*b* is arranged substantially in parallel with the bottom wall 2*a*.

The first coil spring 7 is made of linear metallic material, is helically formed by winding and has a predetermined diameter. The first coil spring 7 is pierced by the strut 2*d* on the bottom wall 2*a* of the lower case 2, surrounds the circular convex 2*g*, is positioned by the convex 2*g*, the upper end surrounds the circular convex 6*j* provided on the back of the base 6*a* of the moving contact 6, is positioned by the convex 2*g* and is elastically touched to the convex 2*g*. That is, the first coil spring 7 is positioned between the convex 6*j* of the base 6*a* of the moving contact 6 and the circular convex 2*g* of the lower case 2.

At this time, the first contact 6*g* and the second contact 6*h* of the moving contact 6 are elastically touched to each fixed contact 5*a* of a pair of fixed terminals 5 by the spring of the first coil spring 7. In this state, the base 6*a* of the moving contact 6 is inclined to each fixed contact 5*a*. The inclination of the base 6*a* of the moving contact 6 is formed by the spring of the first coil spring 7.

The second coil spring 8 is made of linear metallic material, is helically formed by winding and has an outside diameter smaller than that of the first coil spring 7. The second coil spring 8 is pierced by the strut 2*d* of the lower case 2 and is arranged on the bottom wall 2*a* of the lower case 2 coaxially with the first coil spring 7 inside the first coil spring 7. In this state, the second coil spring 8 is positioned by the strut 2*d*.

Also, in this state, the second coil spring 8 pierces the circular base 6*a* of the moving contact 6.

The upper end of the second coil spring 8 is elastically touched to the upper wall of the second hole 4*d* of the operating shaft 4 and pushes up the operating shaft 4 in the axial direction of the operating shaft 4. In other words, the second coil spring 8 is arranged between the bottom wall 2*a* of the lower case 2 and the second hole 4*d* of the operating shaft 4 and is elastically touched to them.

A pin 9 is made of linear metallic material such as copper and stainless steel and is formed substantially in a C-letter shape. One end of the pin 9 is inserted into the long hole 1*h* of the upper case 1 and is fitted into the cam concave 4*e* of the operating shaft 4. The other end is fitted into the fitting part 1*g* of the upper case 1. In this state, as the pin 9 is fitted into the cam concave 4*e* of the operating shaft 4, so-called heart cam operation involved by the fluctuation in the axial direction of the operating shaft 4 is enabled.

A leaf spring 10 is made of elastic linear metallic material such as stainless steel, is formed substantially in an O-letter shape and is composed of a pair of opposite fitting parts 10*a* and 10*a* and an elastically touching part 10*b*. The leaf spring 10 is fitted in a state that a pair of fitting parts 10*a* and 10*a* and both ends of the elastically touching part 10*b* are respectively hooked on two pairs of four L-letter shaped protrusions 1*f* of the upper case 1 and is arranged along the side wall 1*c* of the upper case 1.

In this state, the substantial center of the elastically touching part 10*b* is elastically touched to the pin 9. The pin 9 is held along the side wall 1*c* by the elastic contact to the pin 9 of the elastically touching part 10*b*.

Next, a process for assembling the switch according to the invention will be described.

First, the first coil spring 7 is laid on the bottom wall 2*a* of the lower case 2 so that the cylindrical strut 2*d* of the lower case 2 pierces the first coil spring. Next, the moving contact 6 is laid at the upper end of the first coil spring 7 and is housed in the lower case 2 against the spring of the first coil spring 7. At this time, the strut 2*d* pierces the circular base 6*a* of the moving contact 6.

At this time, both ends of the first arm 6*b* and the second arm 6*c* of the moving contact 6 are fitted by the fitting parts (the convexes) 2*f* and 2*f* of the side walls 2*b* and 2*b* of the lower case 2 so that the moving contact 6 is prevented from being released outside the lower case 2. That is, the moving contact 6 and the first coil spring 7 are held in the lower case 2 in a state that they are temporarily tacked.

Next, a pair of fixed terminals 5 are press-fitted and fixed to the bottom wall 2*a* of the lower case 2 from the upside of the moving contact 6 and the fitting to the fitting parts (the convexes) 2*f* and 2*f* of the moving contact 6 temporarily tacked in the lower case 2 is released against the pressure of the first coil spring 7 by a pair of fixed terminals 5.

The second coil spring 8 is pierced by the cylindrical strut 2*d* of the lower case 2. At this time, the second coil spring 8 is arranged in a state that it pierces the circular base 6*a*.

Next, the strut 2*d* is inserted into the cylindrical first hole 4*c* of the operating shaft 4. At this time, the end of the second coil spring 8 is elastically touched to the upper wall of the second hole 4*d*.

Next, the upper case 1 and the lower case 2 are snap-in integrated so that the upper case 1 covers the lower case 2. Hereby, the body 3 is formed, the operating shaft 4 and others are housed in the body 3 and in this state, the control 4*b* of the operating shaft 4 is protruded outside from the upper end of the sleeve 1*d* of the upper case 1.

Next, the pin 9 is inserted into the long hole 1*h* of the upper case 1 from the outside of the body 3 and is fitted into the cam concave 4*e* forming the heart cam of the operating shaft 4. Next, the pin 9 is latched on the upper case 1 by the leaf spring 10.

As a result, the assembly of the switch is completed.

Next, the operation of the switch according to the invention will be described.

Figure 3:
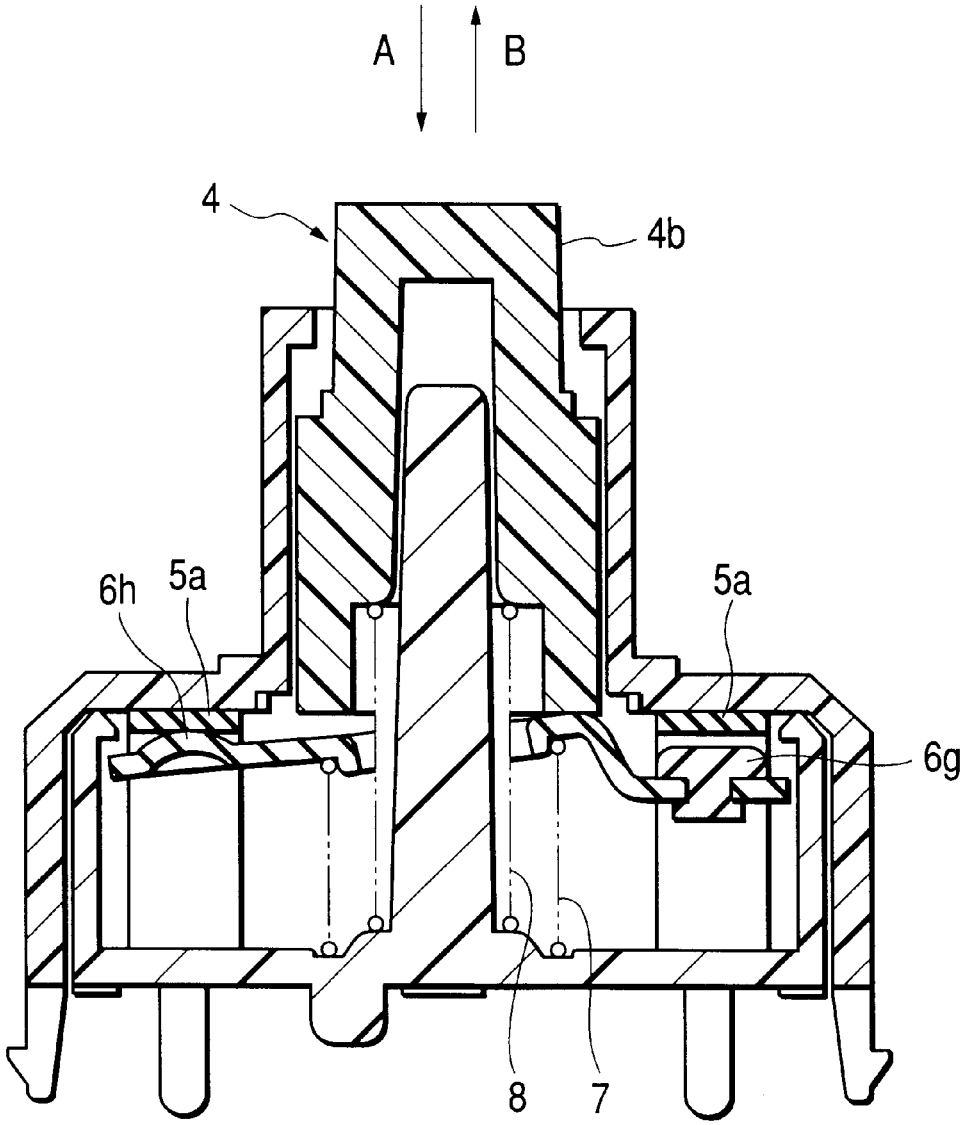
FIG. 3 is a first explanatory drawing for explaining first operation of the switch according to the invention.
Figure 4:
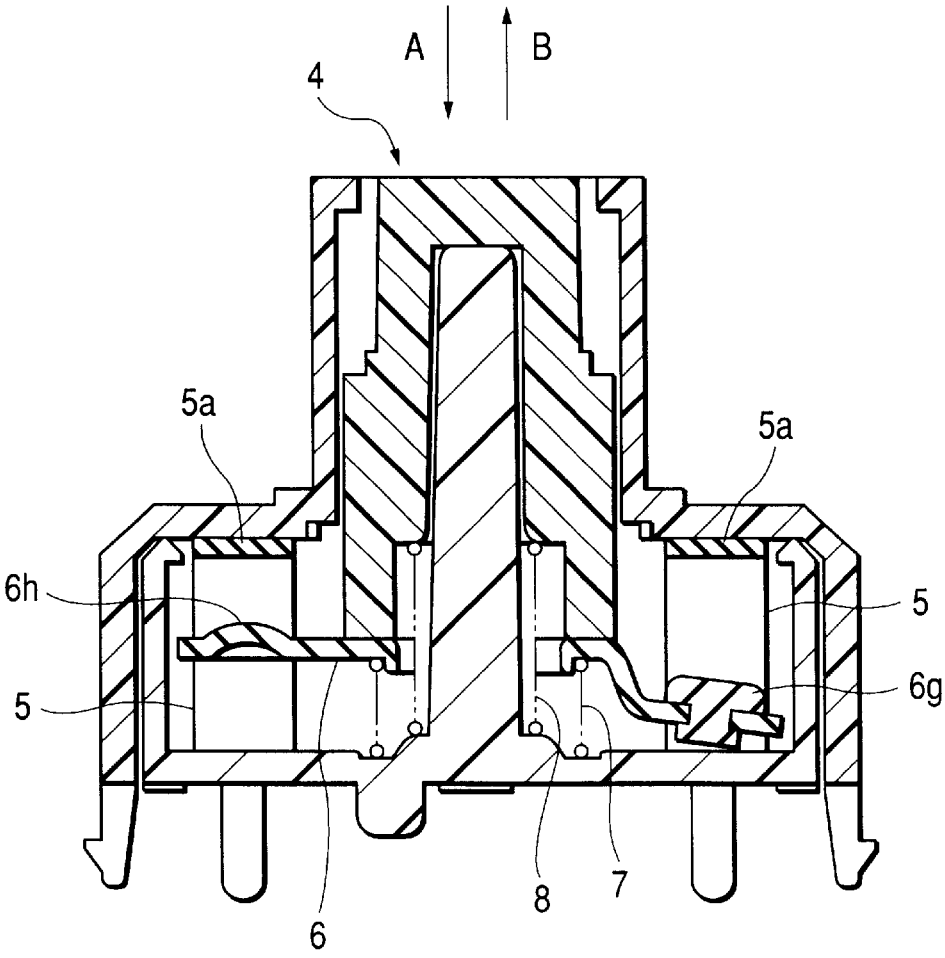
FIG. 4 is a second explanatory drawing for explaining second operation of the switch according to the invention.
Figure 5:
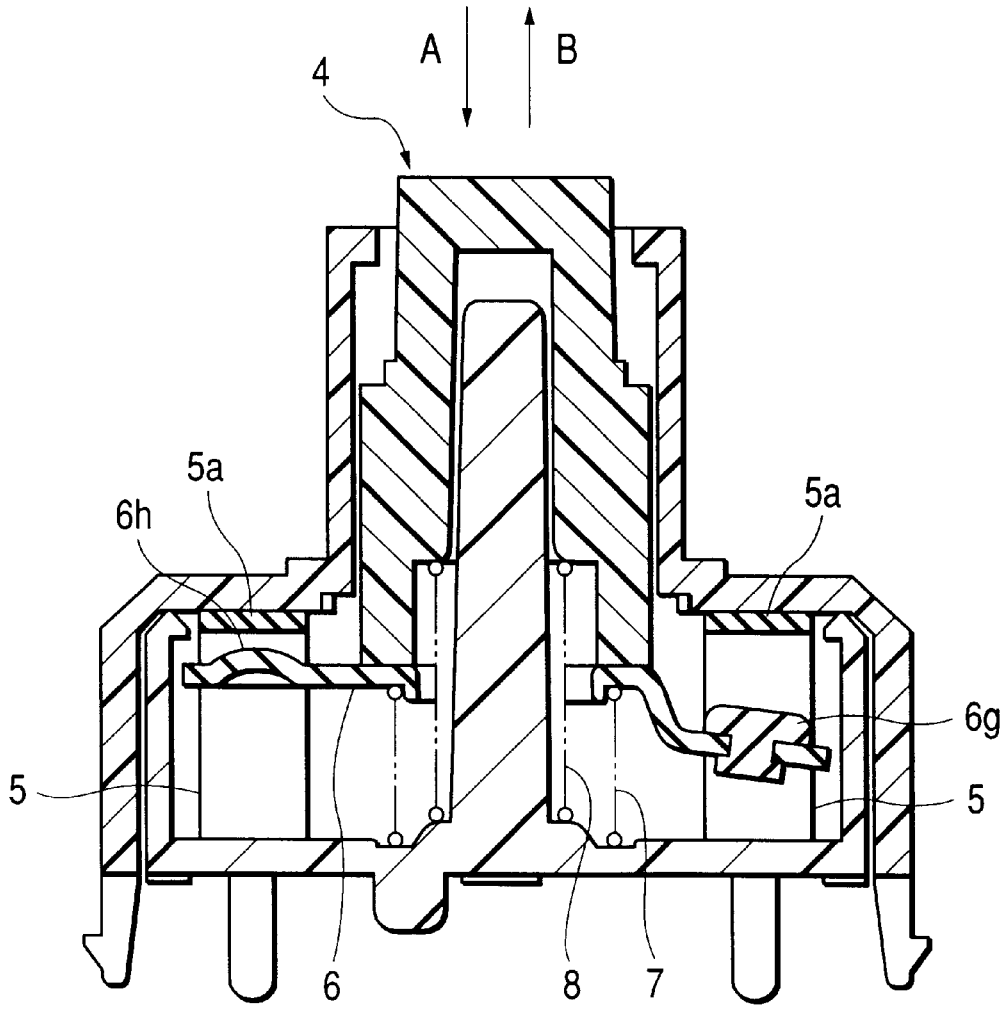
FIG. 5 is a third explanatory drawing for explaining third operation of the switch according to the invention.

FIG. 3 is a first explanatory drawing for explaining first operation of the switch according to the invention, FIG. 4 is a second explanatory drawing for explaining second operation of the switch according to the invention and FIG. 5 is a third explanatory drawing for explaining third operation of the switch according to the invention.

First, the switch is turned on because the first contact 6*g* and the second contact 6*h* of the moving contact 6 are elastically touched to each fixed contact 5*a* of the fixed terminal 5.

Next, the operating shaft 4 of the switch is moved (pressed) by approximately 2 mm for example in a direction shown by an arrow A as shown in FIG. 3 from this state. The movement in the direction shown by the arrow A is made against the spring of the first coil spring 7 and the second coil spring 8.

A part of the lower end face of the base 4*a* of the operating shaft 4 is touched to the bent part 6*k* between the base 6*a* of the moving contact 6 and the first arm 6*b* by the movement of the operating shaft 4, the base 6*a* of the moving contact 6 is moved (pushed down) and the first contact 6*g* made of noble metal of the moving contact 6 is earlier separated from the fixed contact 5*a* of one fixed terminal 5 by the movement of the base 6*a*. The switch is turned off by the separation from the fixed contact 5*a* of the first contact 6*g*.

The separation from the fixed contact 5*a* of the first contact 6*g* causes so-called arc discharge when comparatively large direct current flows in the switch, however, as the first contact 6*g* is made of noble metal, the damage of the first contact 6*g* by arc discharge is small.

Next, as shown in FIG. 4, the operating shaft 4 of the switch is further moved (pressed) by approximately 3 mm for example in the direction shown by the arrow A. The movement in the direction shown by the arrow A is made against the spring of the first coil spring 7 and the second coil spring 8. The base 6*a* of the moving contact 6 is further moved (pushed down) by the movement of the operating shaft 4 of the total approximately 5 mm (approximately 2 mm+approximately 3 mm) and the second contact 6*h* of the moving contact 6 is separated from the fixed contact 5*a* of the other fixed terminal 5 by the further parallel movement of the base 6*a*. The moving contact 6 of the switch is securely separated from a pair of fixed terminals 5 by the separation of the second contact 6*h* from the fixed contact 5*a* and is completely turned off.

In this state, the base 6*a* of the moving contact 6 is arranged in a position parallel to each fixed contact 5*a* of the fixed terminals 5.

As the separation from the fixed contact 5*a* of the second contact 6*h* is separation in a state that the switch is already off, no arc is caused between the fixed contact 5*a* and the second contact 6*h*.

Afterward, when force for operating the operating shaft 4 is removed, the operating shaft 4 of the switch is moved (returned) by approximately 1.5 mm for example in a direction shown by an arrow B as shown in FIG. 5. The movement in the direction shown by the arrow B is made by the self-restitutive force of the first coil spring 7 and the second coil spring 8. One end of the pin 9 shown in FIG. 1 is fitted into a predetermined location of the cam concave 4*e* shown in FIG. 1 forming the heart cam by the movement and the operating shaft 4 remains in a location moved (returned) by approximately 1.5 mm.

In this state, the first contact 6*g* and the second contact 6*h* of the moving contact 6 are separated from each fixed contact 5*a* of the fixed terminals 5, the switch is turned off and this state is maintained even if pressure on the operating shaft 4 is released. A state of so-called push locking is held.

Next, when pressure in the direction shown by the arrow A is applied to the operating shaft 4 from the state shown in FIG. 5, the operating shaft 4 and the moving contact 6 are moved by approximately 1.5 mm against the spring of the first coil spring 7 and the second coil spring 8 to be moved by approximately 5 mm from the initial position shown in FIG. 4 of the operating shaft 4.

Next, when the pressure in the direction shown by the arrow A on the operating shaft 4 is released, the operating shaft is returned to the initial state by the self-restitutive force of the first coil spring 7 and the second coil spring 8, however, on the way, the operating shaft passes a position shown in FIG. 3 and moved by approximately 2 mm from the initial position of the operating shaft 4 as described above.

In this state, the second contact 6*h* is earlier touched to the fixed contact 5*a*. In this contact, as the first contact 6*g* is separated from the fixed contact 5*a* and the switch is turned off, no arc discharge is caused between the fixed contact 5*a* and the second contact 6*h*.

Next, the operating shaft 4 is further moved in the direction shown by the arrow B from the state shown in FIG. 3 and is returned to the initial position shown in FIG. 2. At this time, the first contact 6*g* is touched to the fixed contact 5*a* and the switch is turned on.

When the switch is turned on, so-called arc discharge is caused between the fixed contact 5*a* and the first contact 6*g*, however, as the first contact 6*g* is made of noble metal, the damage by arc discharge of the first contact 6*g* is reduced.

As described above, the invention provides the switch which can be formed using high-priced material for only the first contact on one side, which is low-priced and the stable long life of which can be also achieved by the switching operation of heavy-current by earlier separating the first contact made of noble metal of the moving contact from the fixed contact of the fixed terminal than the second contact by touching the end of the operating shaft to the moving contact and further pushing down the operating shaft against the pressure of the first coil spring and later touching the first contact of the moving contact to the fixed contact of the fixed terminal than the second contact by the pressure of the first coil spring by returning the operating shaft.

Also, the configuration of the switch according to the invention is simplified and the switch can be low-priced because the moving contact is formed of a flat plate, the first arm in which the first contact is provided is bent downward in the bent part for the base, the base is inclined in relation to the fixed contact, the bent part is the closest to the end of the operating shaft and the first and second contacts are elastically touched to each fixed contact respectively by the pressure of the first coil spring on the base of the moving contact.

Also, the invention can provide the switch the space of which can be effectively utilized and which is small-sized because the second coil spring pierces the hole of the moving contact, is arranged coaxially with the first coil spring inside the first coil spring and presses the operating shaft upward in the axial direction of the operating shaft.

Also, the invention can provide the switch in which the first and second coil springs and the operating shaft can be easily positioned because the strut perpendicularly extended from the bottom wall of the body is provided, the first and the second coil springs are provided along the strut and the operating shaft is arranged at the end of the strut so that it can be moved upward or downward in the axial direction.

Also, the body of the switch according to the invention is composed of the upper case and the lower case, the lower case has the opposite side walls, a pair of opposite convexes are formed on the sides of each open end of the side walls and the efficiency of the assembly operation is enhanced by temporarily tacking the moving contact pressed by the first coil spring in the lower case by fitting both ends of the moving contact to a pair of convexes.

What is claimed is:

1. A switch, comprising:

a body;

an operating shaft housed in the body;

a moving contact arranged in the body such that the moving contact is moved in an axial direction of the operating shaft;

a pair of fixed terminals arranged in the body such that the pair of fixed terminals are positioned over the moving contact, a first fixed terminal of the pair of fixed terminals having a first fixed contact and a second fixed terminal of the pair having a second fixed contact; and a first coil spring housed on the side of a bottom wall of the body so that the first coil spring presses the moving contact upward in the axial direction of the operating shaft, wherein the moving contact has first and second contacts provided at both ends, the first contact is made of noble metal, a pair of fixed terminals are respectively provided with a fixed contact, a hole is formed in a center of the moving contact, a second coil spring pierces the hole of the moving contact, the second coil spring is arranged coaxially with the first coil spring inside the first coil spring, the second coil spring presses the operating shaft upward in the axial direction of the operating shaft, the first and second contacts are touched to each fixed contact by pressure of the first coil spring on the moving contact, when the operating shaft moves downward in the axial direction, an end of the operating shaft touches to the moving contact, and further when the operating shaft is pushed down against pressure of the first coil spring, the first contact of the moving contact is separated from the first fixed contact earlier than the second contact is separated from the second fixed contact, and when the operating shaft returns, the first contact of the moving contact is touched to the first fixed contact of the fixed terminal later than the second contact is touched to the second fixed contact by the pressure of the first coil spring.

2. A switch according to claim 1, wherein the moving contact is formed by a flat plate and is composed of a base substantially in a center and first and second arms at both ends, the first arm in which the first contact is provided is bent downward in a bent part in relation to the base, and the first and second contacts are touched to each of the first and second fixed contacts by inclining the base in relation to the first and second fixed contacts and the bent part of the moving contact, due to its incline and the first coil spring, is closer to an end of the operation shaft.

3. A switch according to claim 1, wherein a strut perpendicularly extends from a bottom wall of the body, the first and second coil springs are provided along the strut, and the operating shaft is arranged at an end of the strut such that the operating shaft can be moved reversibly in the axial direction.

4. A switch, comprising:

a body;

an operating shaft housed in the body;

a moving contact arranged in the body such that the moving contact is moved in an axial direction of the operating shaft;

a pair of fixed terminals arranged in the body such that the fixed terminals are positioned over the moving contact; and a first coil spring housed on a side of a bottom wall of the body such that the first coil presses the moving contact upward in the axial direction of the operating shaft, wherein the body has an upper case and a lower case, the lower case has opposite side walls, a pair of opposite convexes are formed on sides of each open end of the side walls, the moving contact pressed by the first coil spring is temporarily tacked in the lower case by fitting both ends of the moving contact to the pair of convexes, the fixed terminals are attached to the lower case from an upside of the moving contact, fitting between one of the pair of convexes and the moving contact is released by pressing the fixed terminals on the moving contact against pressure of the first coil spring, the upper case covers the lower case from a side of the open end, an end of the operating shaft touches to the moving contact by moving the operating shaft downward in the axial direction, and the moving contact is separated from the fixed terminals by further pushing down the operating shaft against the pressure of the first coil spring, and the moving contact is touched to the fixed terminals by the pressure of the first coil spring by returning the operating shaft.

* * * * *